US005331304A

United States Patent [19]

White et al.

[11] Patent Number: 5,331,304

[45] Date of Patent: Jul. 19, 1994

[54] AMORPHOUS METAL TRANSFORMER CORE

[75] Inventors: James V. White, Waukesha; Donald Stachewicz, Muskego; Robert M. Weier, Waukesha, all of Wis.

[73] Assignee: Cooper Power Systems, Inc., Coraopolis, Pa.

[21] Appl. No.: 944,078

[22] Filed: Sep. 11, 1992

[51] Int. Cl.[5] ..... H01F 27/24

[52] U.S. Cl. ..... 336/234; 336/206; 336/219

[58] Field of Search ..... 336/219, 234, 206

[56] References Cited

U.S. PATENT DOCUMENTS

| | | | |
|---|---|---|---|
| 3,587,168 | 6/1971 | Kolator | 336/206 X |
| 3,959,446 | 2/1976 | Boyd et al. | 336/206 X |
| 4,599,594 | 7/1986 | Siman | 336/92 |
| 4,615,106 | 10/1986 | Grimes et al. | 29/605 |
| 4,648,929 | 3/1987 | Siman | 156/188 |
| 4,663,605 | 5/1987 | Lee | 336/197 |
| 4,673,907 | 6/1987 | Lee | 336/92 |
| 4,707,678 | 11/1987 | Siman | 336/210 |
| 4,709,471 | 12/1987 | Valencic et al. | 29/605 |
| 4,734,975 | 4/1988 | Ballard et al. | 29/606 |
| 4,790,064 | 12/1988 | Ballard et al. | 29/606 |
| 4,798,849 | 12/1988 | Ballard et al. | 336/210 |
| 4,892,773 | 1/1990 | Chenoweth et al. | 428/121 |
| 4,893,400 | 1/1990 | Chenoweth | 29/606 |
| 4,903,396 | 2/1990 | Grimes et al. | 29/606 |
| 4,910,863 | 3/1990 | Valencic et al. | 29/606 |
| 4,924,201 | 5/1990 | Ballard | 336/210 |
| 5,083,360 | 1/1992 | Valencic et al. | 29/606 |
| 5,179,776 | 1/1993 | Boenitz et al. | 336/206 X |
| 5,248,952 | 9/1993 | Bisbee | 336/219 X |

*Primary Examiner*—Leo P. Picard
*Assistant Examiner*—L. Thomas
*Attorney, Agent, or Firm*—Wigman, Cohen, Leitner & Myers

[57] ABSTRACT

An apparatus and method for structurally restraining and reinforcing an amorphous metal core of an electrical transformer employs an adhesive bonding agent applied to the lamination edges and protective layers of the core followed by adhesion of a woven fabric thereto to form a highly permeable oil/air interface with the lamination edges of the amorphous material, while providing an effective chip containment system thereto. A temporary guide sleeve aids the core and coil lacing operation. A method for breaking performance inhibiting interlaminar bonds between the amorphous layers of the core is also disclosed.

8 Claims, 5 Drawing Sheets

AMORPHOUS METAL TRANSFORMER CORE

FIELD OF THE INVENTION

The present invention relates to electrical transformers, and more particularly to a method of manufacturing an amorphous metal transformer core and coil assembly.

BACKGROUND OF THE INVENTION

Electrical transformers are necessary components in many widely-used energy conversion systems. These systems generally relate to the generation, transmission, and utilization of electricity and operate across a broad spectrum of voltage loads. Due to the increasing costs of power generation and its transmission, engineers and scientists are continuously striving to increase the efficiency of these conversion systems. One significant improvement in efficiency has been the use of transformer cores fabricated of extremely thin laminations of an amorphous ferromagnetic strip. Amorphous magnetic strip material provides improved magnetic and electrical characteristics resulting from inherently lower electrical losses. These improved characteristics are the result in part of the thinness and higher electrical resistivity of the material. Accordingly, amorphous metal transformer cores offer improved magnetic coupling characteristics over comparable transformer cores fabricated, for example, of silicon steel laminates. Such improved magnetic coupling results in improved transformer operating efficiency offering a corresponding improvement in the operating efficiency of the energy conversion system in which it is incorporated.

Amorphous ferromagnetic metal, useful in the aforementioned electrical transformer application, is typically manufactured in continuous strips or ribbons of about 0.001 inch thickness. Such strips or ribbons have relatively high tensile strengths, but also have relatively poor ductility, especially after being subjected to a controlled heating cycle of a stress-relieving annealing process. Consequently, the furnace annealed amorphous ferromagnetic material is easily fractured. Accordingly, great care must be taken in the handling of the core of an electrical transformer fabricated of an amorphous metal in order to minimize undesired fracturing of the amorphous metal laminations of the core. During the operations of core fabrication, annealing, lacing of the core through a coil to form a core and coil assembly, and final transformer assembly, and in particular, during the post-anneal operations of core joint opening, lacing, and joint reclosing the amorphous ferromagnetic material is especially susceptible to fracturing and chipping.

Even during a properly aligned rejoining of the displaced core ends following coil lacing, however, some fracturing of the core material will inevitably occur. For example, handling of the core and coil assembly during and subsequent to core lacing and joint reclosure results in a necessary and unavoidable flexing of the core legs, thereby generating an unpredictable amount of chipping and separation of some fractured material from the core. Undesirably, some of this fractured amorphous material may deposit on and possibly short out the windings of the transformer coil or coils. One approach to solving this problem is to capture or contain the fractured material by a yoke-enclosing chip containment apparatus, such as that described in U.S. Pat. No. 4,673,907.

Various arrangements for restricting the flexing of the laminations of the amorphous material in order to minimize the fracture mechanism just described have been devised. However, these arrangements, such as that described in U.S. Pat. No. 4,734,975, generally teach a relatively rigid bonding agent that is applied to the noninterleaved transverse edges of the laminations so as to substantially prevent relative motion between laminations. It is also known that application of an adhesive sealant to the laminated edges of the amorphous metal laminations after winding into a core configuration forms a bonding which is essentially permanently adhered to the core and which results in a permanently sealed core structure.

Yet another problem in the fabrication of prior art wound amorphous metal cores is the necessity of maintaining the relative positions of the annealed amorphous metallic strips after lacing as closely as possible to their positions when the core was annealed. Incorrect replacement of the displaced core ends during the lacing procedure can result in large air gaps between the strips and/or significant mechanical stresses within the amorphous metal thereby impairing magnetic performance of the core, and compromising the low core loss characteristics of the amorphous material.

SUMMARY AND OBJECTS OF THE INVENTION

Accordingly, it is an object of the present invention to provide an improved wound amorphous metal transformer core and coil assembly in which the likelihood of chip contamination of the coil or coils is minimized.

It is another object of the present invention to provide a method for restraining, to the extent necessary, the relative motion between the laminations of the core after annealing and during lacing and transformer assembly operations.

It is a further object to provide an apparatus and method for structurally reinforcing various portions of the amorphous metal core.

Still another object of the invention is to provide a chip containment system for the amorphous transformer core and coil assembly of the present invention.

Yet a further object of the present invention is to provide in situ assembly tools for assembling the coils to a core during the lacing operation.

Another object of the present invention is to provide a method of core and coil assembly that permits reopening of the core joint to allow access for needed replacement or repair of the core or coils of the transformer assembly.

A still further object of the present invention is to provide an improved chip containment system for preventing small particles of amorphous metal material from contaminating the transformer oil in which the core and coil assembly is submerged.

The present invention is directed to a method of and an apparatus for structurally restraining and reinforcing an amorphous metal core for use in an electrical transformer. According to a conventional process, elongated strips or ribbons of an amorphous magnetic material are wound in laminations about a core mandrel to form a laminated core annulus. An inside and an outside protective layer of silicon steel are applied to the innermost and outermost annular surfaces of the amorphous strips, respectively. The wound annulus is then formed into a generally rectangular shape having a pair of yoke portions adjoining and connecting a pair of leg portions. The free ends of the amorphous strips are arranged at one of the yoke portions (the jointed yoke portion) in an interleaved, overlapping or abutting fashion and in this condition, the rectangular core is ready for annealing.

According to the present invention, after annealing, the core is supported at the unjointed yoke portion and separated or opened at the jointed yoke portion so that the ends of the amorphous strips are allowed to hang freely in a downwardly-oriented direction. No bonding agent is applied to the edges of the laminations at this stage of the process. In this condition after the joint has been opened, the core legs are flexed to break interlaminar bonds that may have been created between the amorphous material strips prior to and during the annealing cycle. It has been found, according to the invention, that breaking these interlaminar bonds by flexing the core legs prior to lacing improves the magnetic performance of the amorphous metal core and the electrical performance of a transformer incorporating such a core.

After the joint is opened and the core legs are flexed, a bonding agent, preferably a transformer oil-compatible flexible adhesive or sealant, is applied to the laminations of the leg portions of the core and to adjacent portions of the inner and outer silicon steel layers. Such application maintains the steel layers in correct relationship with the leg portions when the leg portions are displaced away from each other during introduction of the leg portions into the coil window of each coil structure. If the bonding agent is permeable to the oil, the entire surface of the edges of the laminations of each leg portion between the inner and outer silicon steel layers is coated with the bonding agent. An oil permeable bonding agent permits the exchange of air and oil during vacuum filling of the transformer casing with transformer oil.

If the bonding agent is not permeable to the oil, it is applied only about the perimeter of the leg portions and to the steel layers adjacent the leg portions and a fabric, such as a fabric woven from nylon filaments or fibers, is applied to the leg portions so as to cover the laminations of the leg portions and overlap onto the steel layers. The fabric is sufficiently oil-permeable or porous to permit the exchange of air and oil between the leg portions and the transformer exterior during vacuum impregnation of the transformer, yet provides effective chip containment for the leg portions.

After the woven fabric has been applied to the exposed edges of the laminations of the leg portions, a core tube, preferably made of a paperboard material, is wrapped about each leg portion and held in place by pressure-sensitive adhesive tape or by other means such as an adhesive coating. Optionally, prior to application of the core tubes, corner reinforcements may be applied to the corners of each leg portion over the woven fabric using the flexible adhesive. This may be especially useful on transformer units with a rating greater than 75 KVA.

An alternative to the woven fabric for covering the exposed lamination edges of the leg portions is paperboard material strips. These strips may be applied in overlapping fashion to the leg portions after application of the flexible adhesive about the perimeter of the leg portions as described above.

After the core tubes have been applied to the leg portions, the core is ready for "lacing," that is, the core leg portions are introduced or "laced" into the openings or windows of the coils. Prior to lacing, a pair of temporary guide sleeves having closed V-shaped pockets for receiving the two free ends of the opened yoke portion and part of the respective adjoining leg portions and core tubes are installed on the core. The core is then laced to the coils with the temporary sleeves performing the functions of guiding the unjointed yoke portions and leg portions into the coil windows and protecting the free ends of the amorphous metal laminations from damage during lacing. The temporary sleeves also advantageously collect any loose chips that may fall from the free ends of the opened yoke.

Upon completion of the lacing operation, the temporary guide sleeves are removed, the ends of the laminations at the opened yoke portion are rejoined and the free ends of the outer silicon steel layer are connected to secure the core joint. The flexible adhesive is then applied to the perimeter of the jointed and unjointed yoke portions and strips of the woven fabric are applied to the lamination edges of each yoke portion to complete the chip containment system for the core. The application of adhesive only to the perimetrical portions of the yoke and leg portions where the lamination edges are exposed also advantageously permits the exchange of air and oil throughout the entire core during vacuum impregnation.

A further advantage of the above-described construction is that the transformer is readily disassembled either for replacement or repair of the core or one or both of the coils. As those skilled in the art will appreciate, the core joint can be readily reopened by removing the woven fabric and small amount of adhesive from the jointed yoke portion, opening the silicon steel outer layer and jointed yoke portion and unlacing the core from the coils.

The combination of the flexible adhesive, woven fabric, core tubes and the inner and outer silicon steel layers provides a complete enclosure for the amorphous metal laminations and is an especially effective chip containment system that does not detrimentally affect the vacuum impregnation process.

With the foregoing and other objects, advantages, and features of the invention that will become hereinafter apparent, the nature of the invention may be more clearly understood by reference to the following detailed description of the invention, the appended claims, and to the several views illustrated in the drawings.

DETAILED DESCRIPTION OF THE INVENTION

Figure 1:
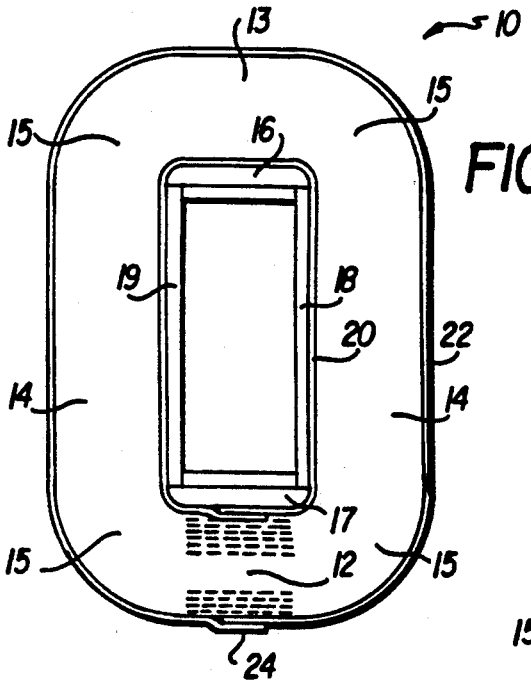
FIG. 1 is a front elevation view of an amorphous metal core shown in a generally rectangular form after annealing.

Referring now in detail to the drawings wherein like parts are designated by like reference numerals throughout, there is illustrated in FIG. 1 a core 10 for assembly into an electrical transformer which may have a core-type configuration or shell-type configuration (not shown). The core 10 is fabricated of a plurality of strips or ribbons of an amorphous ferromagnetic material wound about a two-piece cylindrical core mandrel (not shown) or in a belt nester apparatus (not shown) to form a laminated core annulus with the free ends of each strip situated at a local region. These strips or laminations of amorphous ferromagnetic material are generally cut from one or more continuous lengths wound on supply reels. In one exemplary embodiment, a plurality of amorphous ferromagnetic strips form a "book," and a plurality of overlying books are nested together such that each book end is staggered from the next book end by a given spacing in the closed core structure.

Inside and outside overlapping protective layers 20, 22 of silicon electric steel strip are wound as the innermost and outermost layers or laminations, respectively, of the core and after winding, the overlapping ends of the outer layer 22 are interlocked by a locking connection 24 or by a temporary banding strap (not shown). The wound annulus together with the layers 20, 22 is then formed into the generally rectangularly shaped core 10 shown in FIG. 1 by a suitable forming apparatus (not shown), such as a conventional two-way press having a system of opposing pneumatically-operated pistons which are urged against opposite sides of the inner periphery of the annulus to form the core into a particular rectangular configuration.

After forming, the core 10 is supported in its generally rectangular shape by a pair of opposed horizontal supports 16, 17 held in spaced apart relation by a pair of opposed vertical supports 18, 19. The core 10 thus comprises a pair of yoke portions, a jointed yoke portion 12 and an unjointed yoke portion 13, adjoining a pair of leg portions 14 at four corner portions 15. The free ends of the laminations of amorphous strip material are located in the jointed yoke portion 12 in an interleaved, overlapping and/or abutting relation. The core 10 is thus supported in a substantially rigid configuration of FIG. 1 by the supports 16, 17, 18, 19 and the outer protective layer or locking turn 24. Preferably, four additional support plates (not shown) are provided on the exterior surfaces of the two leg portions and two yoke portions 12, 13 and held in place by one or more steel straps. In either of these configurations, the core 10 is thermally annealed or magnetically annealed according to an appropriate annealing cycle.

Figure 2:
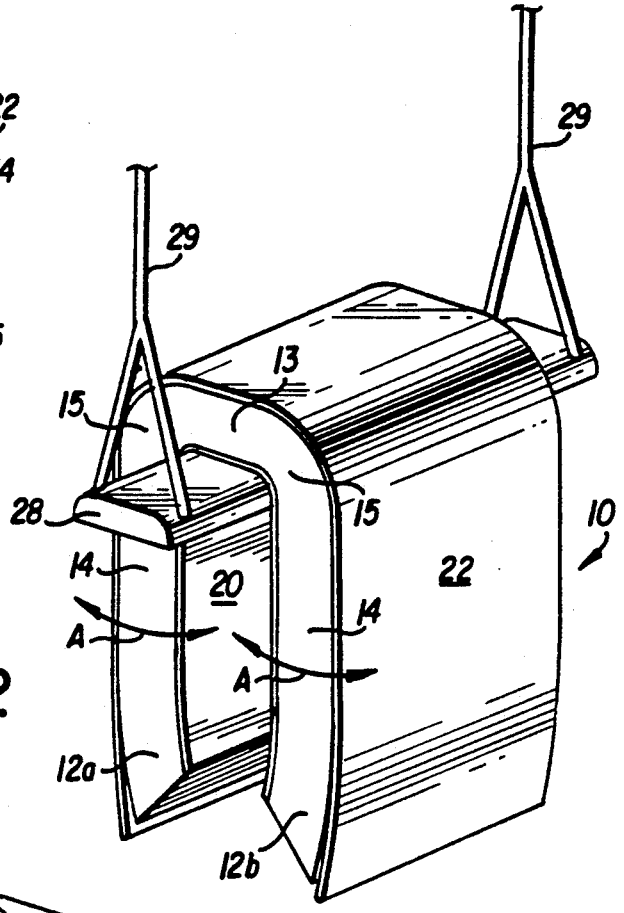
FIG. 2 is a perspective view of the amorphous metal core of FIG. 1, shown suspended from a hanger with the jointed yoke portion opened.

Now referring to FIG. 2, an amorphous metal core 10 is shown suspended from the unjointed yoke portion 13 by a hanger 28 and sling 29 assembly subsequent to the annealing process and after the locking connection 24 (FIG. 1) has been released and the jointed yoke portion 12 has been separated or opened into two end portions 12*a*, 12*b*. The horizontal support 16 located at the unjointed yoke portion 13 used during initial fabrication of the core 10 is replaced by the hanger 28 in the following manner. The annealed core 10 is placed on a horizontal surface of a tilt table (not shown). The horizontal support 16 located adjacent the unjointed yoke portion 13 is slidably removed from the core 10 as the hanger 28 is simultaneously and slidably inserted in place of the support 16. After the hanger 28 has been completely inserted and properly positioned, the tilt table is tilted to position the core 10 in a vertical position and the slings 29 are secured to a respective end of the hanger 28 to support the core 10 during subsequent assembly procedures.

When the core 10 is suspended from its unjointed yoke portion 13 by the hanger 28, the locking connection 24 is released and the freely hanging jointed yoke portion 12 is separated or opened into the two joint end portions 12*a*, 12*b*. The remaining horizontal support 17 and vertical supports 18, 19 are also removed. The joint end portions 12*a*, 12*b* and the free ends of the inner and outer protective layers 20, 22 will hang downwardly by gravity resulting in the generally inverted U-shaped configuration of the core 10 as shown in FIG. 2.

Each leg portion 14 is then vibrated, flexed, struck with a mallet or pivoted back-and-forth a few times about its respective upper corner portion 15 as shown by the arrows A to break interlaminar bonds that may have been created between the layers of amorphous material prior to and during the annealing process. It has been found that breaking these bonds, whether by machine or manual manipulation of each leg portion 14 in the manner described, appears to improve the magnetic performance of the amorphous metal core.

Figure 3:
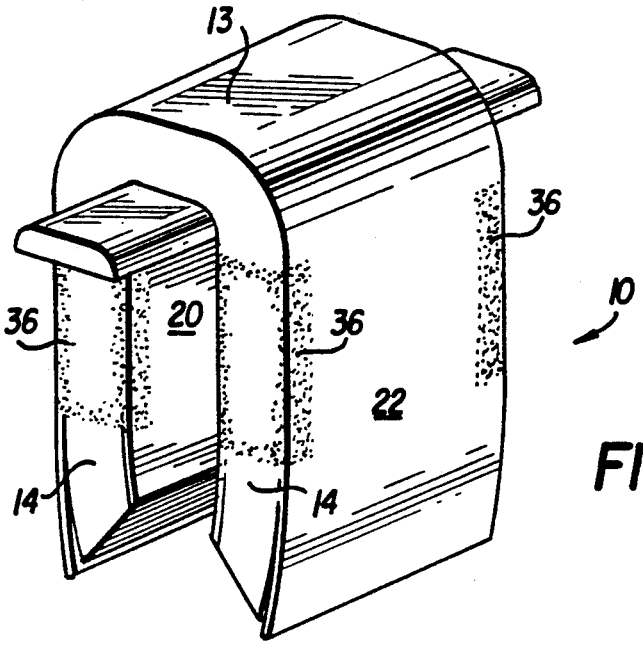
FIG. 3 is a perspective view of the unjointed core of FIG. 2, showing a flexible adhesive selectively applied to the leg portions of the core in accordance with the present invention prior to the application of a chip-containing fabric to the leg portions of the core.

According to a preferred embodiment of the present invention as shown in FIG. 3, beads of a flexible adhesive bonding agent 36 (shown in the drawings by stippling), are applied to the exposed edges of the laminations of each leg portion 14 immediately adjacent the inner and outer silicon steel protective layers 20, 22, respectively. It has been found that a suitable sealant is a silicon-based, transformer oil-compatible sealant available under the tradename Silgan Elastomer, Part No. J-500 from Wacker Silicon Corp., Adrian, Mich. Additional beads of the bonding agent 36 are applied to the protective layers 20, 22 adjacent the beads disposed on the lamination edges and along the straight portions of the legs 14. It is known that a flexible bonding agent, in contrast to a rigid bonding agent, will more readily accommodate thermal expansion stresses generally occurring during transformer operation, while maintaining the leg portion laminations and steel layers in correct assembled relationship, as will be further described below. The beads of adhesive as applied to the edges of the silicon steel layers 20, 22 extend from about 0.125 to about 0.5 inch, and preferably about 0.25 inch from the core edges 21 along the outer surfaces of the layers 20, 22 to consolidate the layers 20, 22 with the laminations of the core. The adhesive bonding agent 36 also serves as a physical barrier against abrasion between the core edges and the coil. A chip-containing sheet material is then applied over the bonding agent 36, as will be further described below.

If the bonding agent 36 is permeable to the transformer oil in which the assembled transformer coil and core will be submerged, then the entire surface of the edges of the laminations of each leg portion 14 between the inner and outer silicon steel layers 20, 22, respectively, may be coated with the bonding agent 36. The bonding agent 36 may also extend to the adjacent steel layers 20, 22 to further maintain the leg portion laminations and steel layers 20, 22 in correct assembled relationship, especially during disassembly and reassembly at the jointed yoke portion 12 of the core 10. Such permeability of the bonding agent 36 permits exchange of air and oil to/from the core 10 during vacuum filling of the transformer casing with transformer oil.

Figure 4:
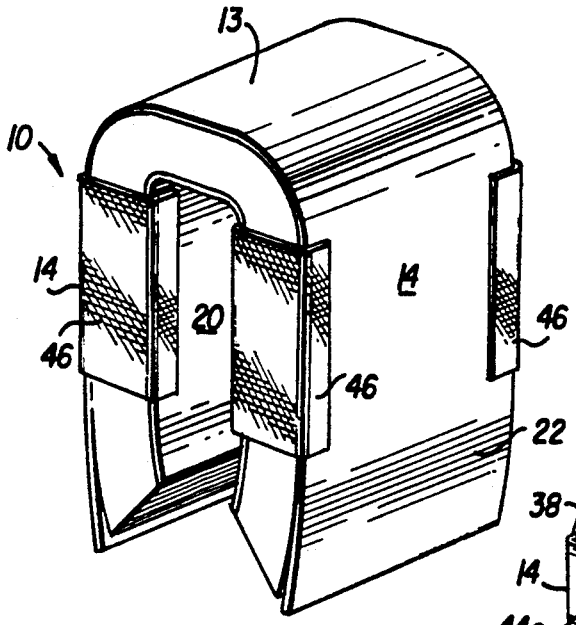
FIG. 4 is a perspective view of the core of FIG. 3, showing an oil-permeable fabric applied to the leg portions by the adhesive applied selectively to the leg portions as shown in FIG. 3.
Figure 5:
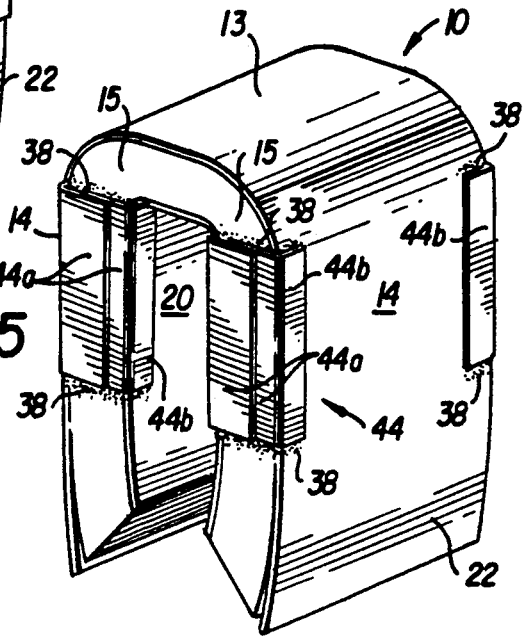
FIG. 5 is a perspective view of an alternate embodiment of the invention in which overlapping paperboard strips are adhesively adhered to the leg portions of the core in lieu of the fabric shown in FIG. 4.

Assuming the bonding agent is not permeable to the transformer oil, FIGS. 4 and 5 show alternative embodiments for chip containment and for maintaining the laminations of the leg portions 14 in correct assembled relationship during subsequent lacing and rejoining operations. Referring first to FIG. 4, the perimetrical edges of the laminations and layers 20, 22 of the leg portions 14 of core 10 have been coated with the bonding agent 36 as shown in FIG. 3. While the bonding agent is still tacky, a nylon fabric strip 46, woven from nylon filaments or fibers and having a thickness in the range of about 3–10 mils (0.003–0.010 inches), is adhered to the leg portions 14 by the bonding agent 36 so as to cover the laminations of the leg portions and overlap the steel layers 20, 22. The fabric strips 46 are sufficiently oil-permeable or porous to allow for the exchange of air and oil between the leg portions and the transformer exterior during vacuum impregnation of the transformer, yet prevent small particles of amorphous metal material from contaminating the transformer oil in which the core and coil assembly is submerged, thus providing effective chip containment for the leg portions.

Referring now to the FIG. 5 embodiment, paperboard material strips 44 may be substituted for the woven fabric material strips 46. Each strip 44 includes a front portion 44*a* and a side portion 44*b* of substantially equal width and folded substantially at right angles to one another. The front portions 44*a* of the strips 44 overlap one another and are adhered to the leg portions 14 by the tacky bonding agent 36 and by an adhesive applied between the overlapping portions of the front strip portions 44*a*.

The strips 44 are preferably cut to a length such that the entire straight portions of the legs 14 of the core 10 are covered by the strips. The strips 44 preferably extend to the corner portions 15, but do not extend so far as to restrict the motion of the leg portions 14 necessary to enable opening, and reclosing of the core joint 12 and lacing of the core 10. Beads 38 of bonding agent 36 may be applied at the top and bottom edges of the paired strips 44*a*, 44*b* if necessary to seal the spaces between the strips and the edges of the laminations and thereby form a chip containment system encompassing those regions of the leg portions 14 of the core underlying the paired strips 44. The adhesive beads 38 if needed are preferably applied immediately after the strips 44 have been adhesively attached to the leg portions 14, but may be subsequently applied, for example, after lacing the core should it become necessary.

After the core 10 has been assembled with a chip containment system according to one of the embodiments of FIGS. 4–5, and optionally with corner reinforcements, the lacing operation is ready to be performed. Preferably, the bonding agent 36 is allowed to set until it is "skinned over" or dry to the touch before lacing. It is known that a cure time of about twenty-four hours is required to cure the Silgan Elastomer J-500 sealant. However, if the bonding agent is still wet or tacky, it may be covered with an oil compatible insulator or paper to permit immediate handling.

Figure 6:
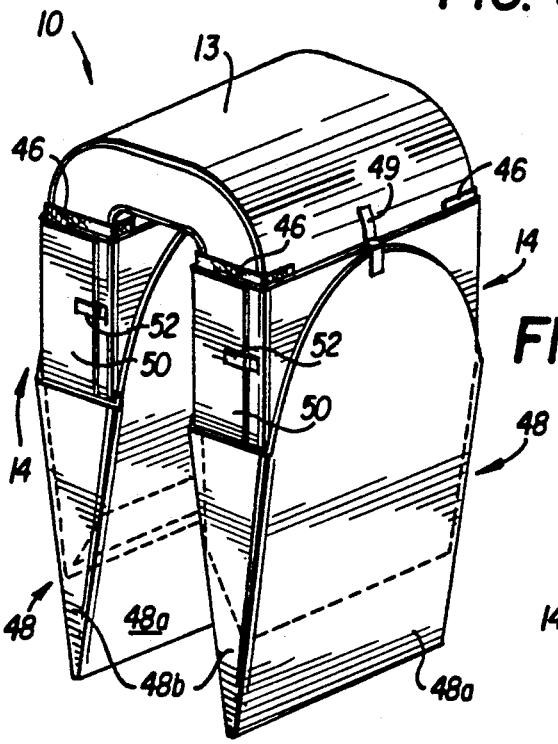
FIG. 6 is a perspective view of a pair of temporary guide sleeves shown installed over the leg portions and core tubes of the opened core prior to lacing.

Now referring to FIG. 6, after the woven fabric material has been applied to the core 10 as described above, a core tube 50, preferably fabricated of a paperboard material of a type conventionally used in similar transformer applications, is wrapped about each leg portion 14, overlapped, and held in place by pressure-sensitive adhesive tape 52 or by other means such as an adhesive coating. The core tubes 50 have a length or height substantially the same as the length of the leg portions 14 and provide some additional rigidity to the enclosed leg portions 14. Optionally, prior to application of the core tubes 50, corner reinforcements similar in shape and size to the corner segments 44 shown in FIG. 5 may be applied to the corners of each leg portion 14 using the adhesive agent 36. This may be especially useful on transformer units with rating greater than about 75 KVA.

As an aid to the lacing operation in which the core leg portions 14 are introduced or "laced" into the openings or windows of the coils, a temporary guide sleeve 48 having a V-shaped pocket is installed about each leg portion 14 over each core tube 50, as also shown in FIG. 6. Each sleeve 48 includes paired panels 48*a* fabricated from silicon steel sheet such as that used for the overlaying protective layers 20, 22, or other suitable material, especially a material having a low coefficient of sliding friction. The panels 48*a* span the width of the leg portion 14 and converge into a V-shaped pocket sized to accept the free end of the leg portion 14. Corresponding sides of the panels adjacent the converged portion are bridged by V-shaped end panels 48*b* fabricated from a resin impregnated fabric or other smooth cloth having a low coefficient of sliding friction. After guide sleeves 48 are slidably installed on the leg portions 14, the panels 48*a* of each guide sleeve 48 overlaying the outer silicon steel layer 20 are affixed thereto by a length of removable adhesive tape 49 or other suitable temporary fixing means. The temporary sleeves 48 perform the functions of guiding the unjointed yoke portions 12*a*, 12*b* and leg portions 14, 14 into the coil windows and protecting the free ends of the amorphous metal laminations from damage during the lacing procedure.

Figure 7:
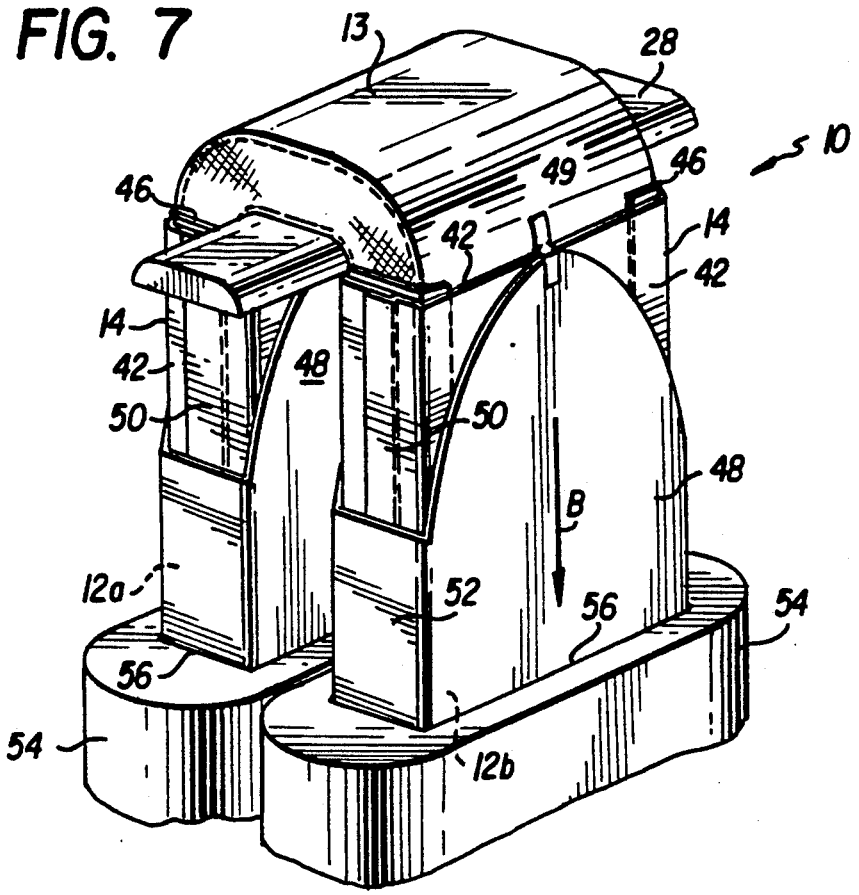
FIG. 7 is a perspective view of the assembly of FIG. 6 showing the sleeved leg portions of the core partially laced through the coil windows.

FIG. 7 illustrates a lacing operation using a core 10 constructed according to the FIG. 4 embodiment with a pair of temporary sleeves 48 shown in FIG. 6, although it should be understood that the embodiment of FIG. 5 may be laced in the same manner. With the core 10 suspended from hanger 28, each core leg 14 wrapped by a core tube 50 is inserted into a respective coil window 56 of coils 54. Lacing is then effected by passing the sleeved legs 14 of the core 10 through the windows 56 by lowering hanger 28 in the direction of the arrow B. The temporary sleeves 48 also advantageously contain any loose chips of amorphous metal that may fall from the free ends of the core during lacing, and especially when the core is suspended above the coils 54.

Continued lowering of the core 10 telescopes the sleeved leg portions 14 into the coil windows 56. If a tight fit exists between the coil windows 56 and the sleeves 48, a suitable lubricant compatible with the transformer oil to be used may be applied to the sleeves 48 or low friction material strips may be disposed about the coil windows 56 to aid in telescoping the core 10 into the coils 54. Also, when a flexible adhesive 36 is used, the core legs 14 may be slightly compressed to facilitate the lacing operation. After lacing, the sleeves 48 are removed and the core expands to fill the available space within the coil and is thus in a more stress-free state. This feature enables the transformer engineer to design amorphous metal transformer cores, such as that of the present invention, with tighter core to coil tolerances.

Figure 8:
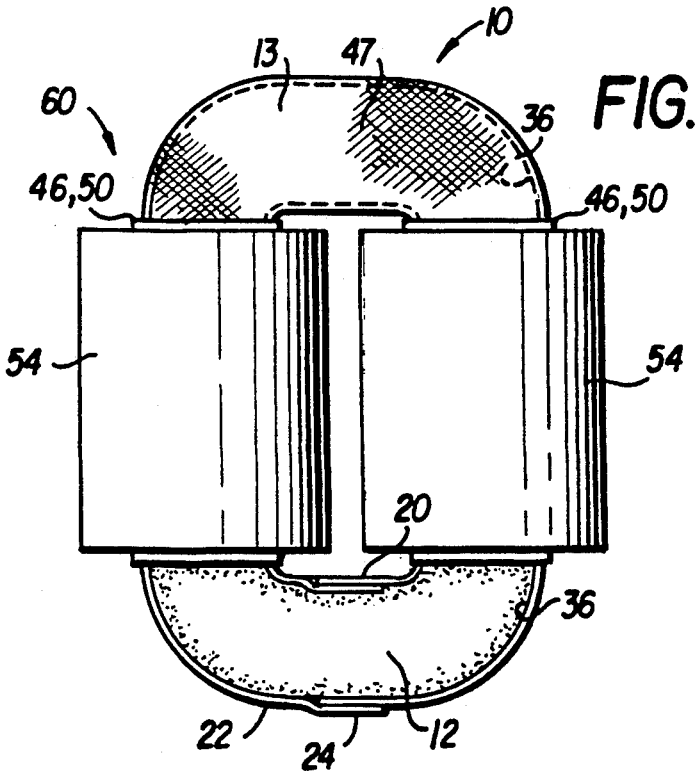
FIG. 8 is a front elevation view of the core as installed through the coils of a core-type transformer with the temporary guide sleeves removed and the opened yoke rejoined.

Referring now to FIG. 8, after lacing according to the procedure described in connection with FIG. 7 and after removing the sleeves 48, the coil and core assembly 60 is positioned horizontally for reclosing or rejoining the jointed yoke 12 and the hanger 28 is removed. The free ends of the laminations of the amorphous metal core 10 are repositioned at the end portions 12*a*, 12*b* into the same or substantially the same positions in which they were disposed after annealing, i.e., the positions of FIG. 1, in order to minimize any magnetic losses as is well understood in the art. The outer protective layer 22 is then drawn tightly about the core and its ends are secured by the locking connection 24.

After the yoke portion 12 has been rejoined as shown in FIG. 8, beads of adhesive bonding agent 36 are applied to the perimeter of the jointed and unjointed yoke portions 12, 13, respectively, as shown by the stippling on the jointed yoke portion 12. Strips 47 (only one shown) of the woven fabric chip containment material are applied to the four lamination edge faces or areas of the yoke portions 12, 13 to complete the chip containment system for the core 10. All lamination edges susceptible to breakage are thus encapsulated by the fabric strips 46, 47 between the inner and outer protective layers 20, 22 and the bonding agent 36 which extends between and overlaps the layers 20, 22 on the leg portions. Furthermore, the application of a permeable adhesive agent, or in the case of limited application of the non-permeable adhesive agent 36 followed by adhesion of the porous fabric 46, 47 to the lamination edges, maximizes the exchange of air and oil throughout the entire core during vacuum impregnation. Following completion of the chip containment system of the present invention, the periphery of the coil and core assembly is thoroughly vacuumed to remove any chips or slivers of detached amorphous material that may have broken off from the lamination prior to closure of the chip containment system.

A further advantage of the above-described construction is that the transformer is readily disassembled either for replacement or repair of the core 10 or one or both of the coils. As those skilled in the art will appreciate, the jointed core joint 12 can be readily reopened by removing the woven fabric and small amount of adhesive bonding agent 36 from the jointed yoke portion 12, opening the silicon steel outer layer 22 and jointed yoke portion 12 and unlacing the core 10 from the coils.

The combination of the flexible bonding agent 36, woven fabric strips 46, 47, core tubes 50 and the inner and outer silicon steel layers 20, 22, respectively, provides a complete enclosure for the amorphous metal laminations and is an especially effective chip containment system that does not detrimentally affect the vacuum impregnation process.

Figure 9:
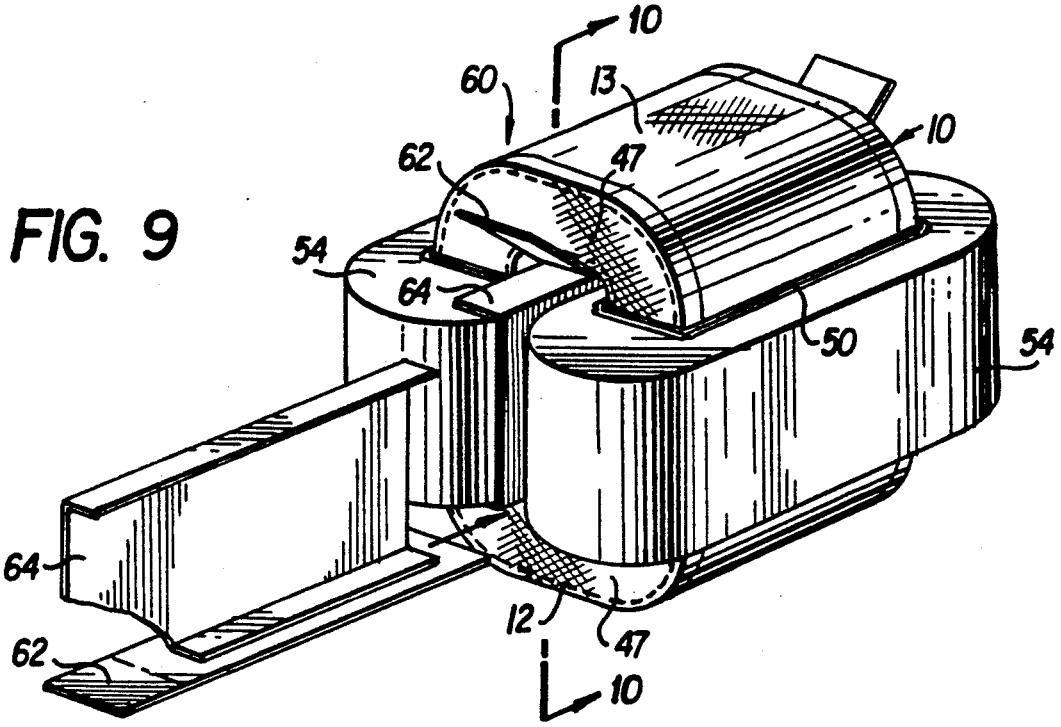
FIG. 9 is a perspective view of a core and coil assembly showing the installation of end pads and between-coil insulation.

FIG. 9 illustrates a core and coil assembly 60 completely encapsulated with the bonding agent 36 and fabric strips 46, 47 to form a chip containment system. Paperboard insulators comprising end pad insulators 62 and between-coil insulators 64 are inserted between the yoke portions 12 and 13 and the tops and bottoms of the coils 54 and between the confronting surfaces of the coils 54 to provide mechanical and electrical insulation between the core and coils and between the coils.

Figure 10:
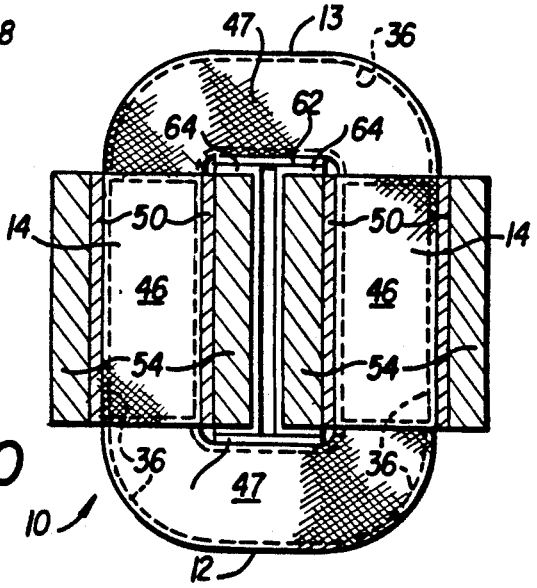
FIG. 10 is a cross-sectional view taken along line 10—10 of FIG. 9.

FIG. 10 is a cross-section illustrating the chip containment system of the present invention applied to one face of the annular core 10. It will be appreciated that the chip containment system on the other face of the annular core has substantially the same configuration. As shown and previously described, each core face is sectioned into four contiguous sealed regions, including the two leg portions 14, the unjointed yoke portion 13, and the jointed yoke portion 12. With the exception of the few amorphous laminations covered by the beads of bonding agent 36, virtually the entire core face is available for oil/air transfer between the core and the transformer oil in which it is submerged.

Figure 12:
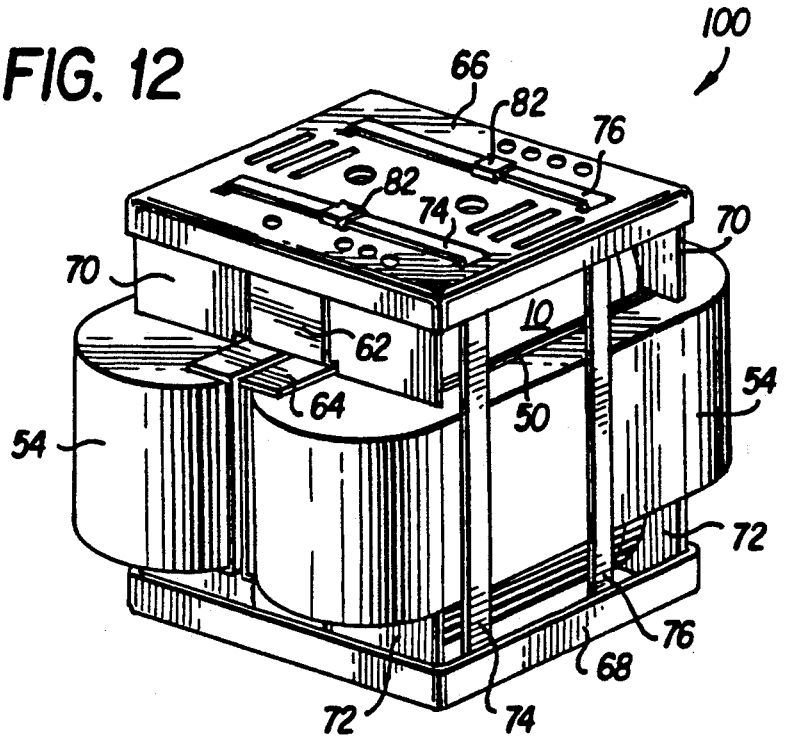
FIG. 12 is a perspective view of a completely assembled core-type transformer made according to the present invention.
Figure 11:
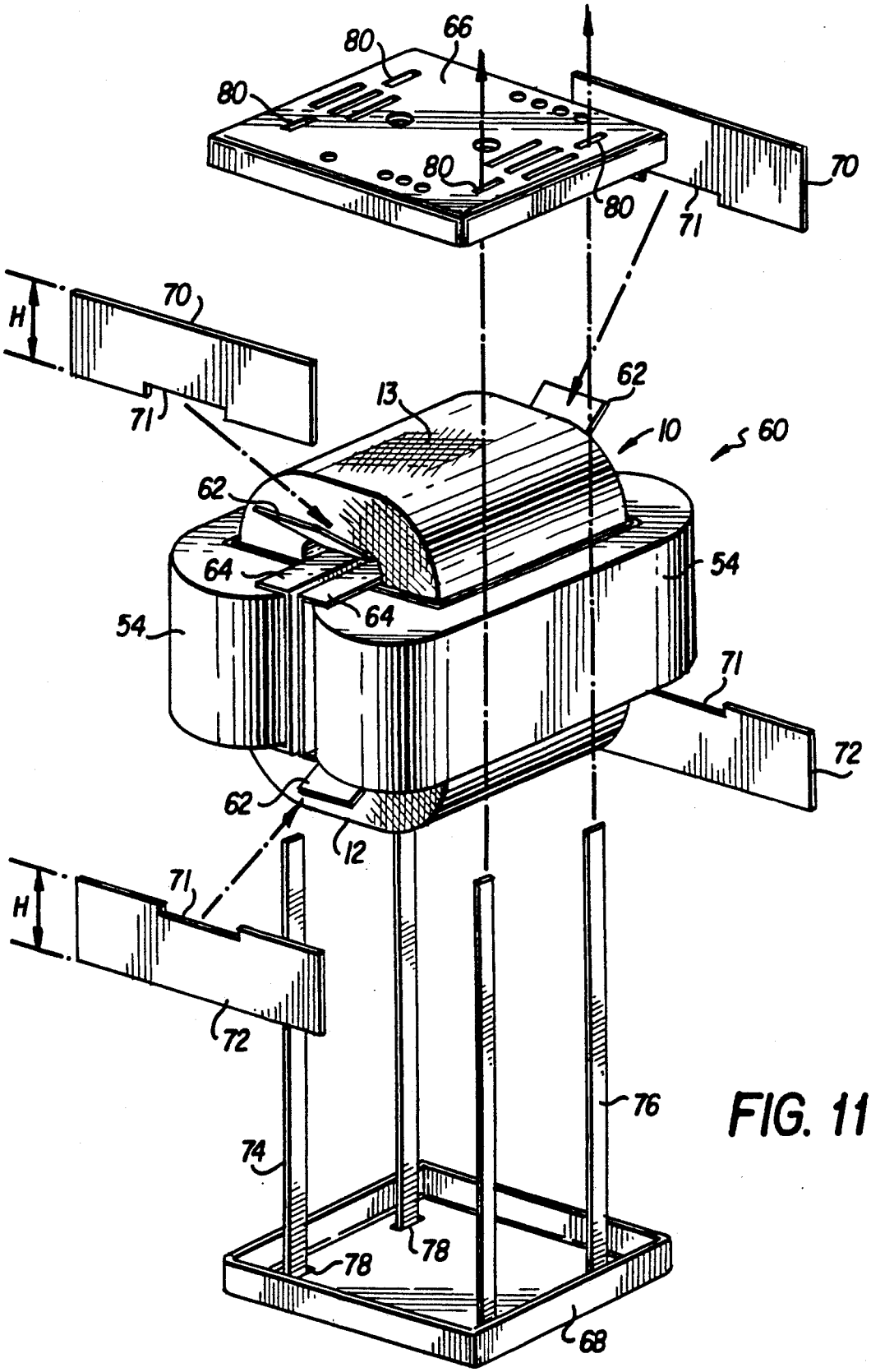
FIG. 11 is an exploded perspective view of a core-type transformer showing the core and coil assembly and the spacers and clamping apparatus for the transformer of the invention.

FIGS. 11 and 12 illustrate the final assembly of the amorphous metal transformer core. The core and coil assembly 60 is supported between upper and lower clamping plates 66, 68, respectively, by a plurality of coil blocks 70 to avoid clamping stresses on the core 10. Coil blocks 70, 72 are positioned parallel to the faces of the yoke portions 12, 13 and are provided with notches 71 to accommodate the end pad and between-coil insulators 62, 64. The height H of the coil blocks 70, 72 is dimensioned so that when the coil blocks 70, 72 are positioned between the coils 54 and the clamping plates 66, 68, no pressure is applied to the yoke portions 12, 13 of the core by the clamping plates 66, 68. Thus, the core 10 is supported or "hung" freely from the coils 54. A slight upward pressure on the jointed yoke portion 12 by the lower clamping plate 68 may be desirable to assist in maintaining the jointed yoke in a closed configuration. This may be accomplished by appropriate selection of the height H of the lower coil blocks 72.

To complete the transformer core assembly 100, a pair of bands or straps 74, 76 are passed through openings 78, 80 in the upper and lower clamping plates 66, 68. The straps 74, 76 are placed under tension to develop a clamping force between the plate 66, coil blocks 70, coils 54, coil blocks 72 and clamping plate 68 and are secured together by clamps 82 while under tension by means of a conventional banding apparatus (not shown).

Although a core-type transformer and its method of assembly have been described, the invention is also applicable to the manufacture of a shell-type transformer, i.e., a transformer comprising two cores with one leg of each laced to one coil, as would be apparent to one skilled in the art. Furthermore, the illustrated cores and coils are exemplary only of cores and coils of a variety of sizes, shapes and cross-sections.

Although certain presently preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. A core assembly for an electrical transformer, comprising:

a core fabricated of a plurality of elongated laminations of an amorphous metal material wound into a shape, said core having two leg portions, a jointed yoke portion, and an unjointed yoke portion opposing the jointed yoke portion, said leg portions connecting the yoke portions, said leg and yoke portions having faces formed by the edges of said amorphous metal laminations, said faces each having a surface area;

a bonding agent applied to the entire surface area of the faces of each of said leg portions and said yoke portions so as to completely cover the surface areas, said bonding agent comprising an adhesive permeable to air and transformer oil; and sheet material strips applied in overlying relation to each of the faces of the leg and yoke portions and secured thereto by said bonding agent whereby chips of amorphous metal are contained in said core.

2. The core assembly of claim 1, wherein said bonding agent is a flexible adhesive.

3. The core assembly of claim 1, wherein said sheet material is a porous woven fabric.

4. The core assembly of claim 1, including a core tube wrapped about each leg portion.

5. The core assembly of claim 4, wherein said core tube is made of a paperboard material.

6. The core assembly of claim 1, wherein said sheet material comprises strips of porous paperboard material.

7. A core assembly for an electrical transformer, comprising a core fabricated of a plurality of elongated laminations of an amorphous metal material wound into a shape, said core having two leg portions, a jointed yoke portion, and an unjointed yoke portion opposing the jointed yoke portion, said leg portions connecting the yoke portions, said leg and yoke portions having faces formed by the edges of said amorphous metal laminations, said faces each having a surface area, a bonding agent applied to the entire surface area of the faces of each of said leg portions and said yoke portions so as to completely cover the surface areas, said bonding agent comprising an adhesive permeable to air and transformer oil.

8. The core assembly of claim 7 including sheet material strips applied in overlying relation to each of the faces of the leg and yoke portions and secured thereto by said bonding agent whereby chips of amorphous metal are contained in said core.

* * * * *